US007108664B2

(12) United States Patent
Mason et al.

(10) Patent No.: US 7,108,664 B2
(45) Date of Patent: Sep. 19, 2006

(54) CONTINUOUS PASSIVE MOTION DEVICE FOR REHABILITATION OF THE ELBOW OR SHOULDER

(75) Inventors: Jeffrey T. Mason, Escondido, CA (US); Mark E. Howard, San Diego, CA (US)

(73) Assignee: Breg, Inc., Vista, CA (US)

( * ) Notice: Subject to any disclaimer, the term of this patent is extended or adjusted under 35 U.S.C. 154(b) by 234 days.

(21) Appl. No.: 10/285,861

(22) Filed: Nov. 1, 2002

(65) Prior Publication Data

US 2004/0087880 A1 May 6, 2004

(51) Int. Cl.
*A61H 1/02* (2006.01)

(52) U.S. Cl. ..... 601/5; 601/33

(58) Field of Classification Search ..... 601/5, 601/23, 26, 33, 40, 34, 35
See application file for complete search history.

(56) References Cited

U.S. PATENT DOCUMENTS

| | | | | | |
|---|---|---|---|---|---|
| 2,274,574 | A | | 2/1942 | Zerne | 272/57 |
| 2,315,997 | A | | 4/1943 | Ginsburg | 128/25 |
| 2,633,124 | A | | 3/1953 | Yellin | 128/75 |
| 3,301,552 | A | | 1/1967 | Ryan | 272/80 |
| 3,892,230 | A | | 7/1975 | Baker et al. | 128/25 R |
| 4,431,181 | A | * | 2/1984 | Baswell | 482/38 |
| 4,489,713 | A | | 12/1984 | Latenser | 128/71 |
| 5,179,939 | A | | 1/1993 | Donovan et al. | 128/25 R |
| 5,254,060 | A | * | 10/1993 | Bohanan | 482/60 |
| 5,290,219 | A | | 3/1994 | Hetrick | 602/32 |
| 5,449,336 | A | | 9/1995 | Sabel | 482/133 |
| 5,480,375 | A | * | 1/1996 | La Fosse et al. | 601/23 |
| 5,501,656 | A | | 3/1996 | Homma et al. | 601/33 |
| 5,571,075 | A | | 11/1996 | Bullard | 601/152 |
| 5,632,726 | A | | 5/1997 | Repice et al. | 602/36 |
| 5,716,330 | A | * | 2/1998 | Goldman | 601/26 |
| 5,916,182 | A | * | 6/1999 | Fengler | 601/110 |
| 6,019,235 | A | * | 2/2000 | Ferrigan | 211/195 |
| 6,261,250 | B1 | * | 7/2001 | Phillips | 601/23 |

* cited by examiner

*Primary Examiner*—Danton DeMille
(74) *Attorney, Agent, or Firm*—Rodney F. Brown

(57) ABSTRACT

A continuous passive motion device is provided having specific application to rehabilitative treatment of the elbow or shoulder. The device includes a motorized winch displacable in a first or second direction, a cord suspended from the winch by a variable extension length, which increases when the winch is displaced in the first direction and decreases when the winch is displaced in the second direction, and an arm harness associated with the cord. An arm of a patient is suspended from a suspension point on the cord and the motorized winch is activated to alternately displace the winch in the first and second directions, thereby providing a plurality of repetitive treatment cycles. Each treatment cycle moves the suspension point and correspondingly the elbow or shoulder from a lower treatment limit to an upper treatment limit and back to the lower treatment limit.

14 Claims, 9 Drawing Sheets

95
14
44b
46b
102
118
116
114
12
50
26b
10
74
52b
16
56
47b
48
80
18
54b
88b
38
24b
32b
37b
86b
39b
36b
22b
35b
28
30b 95
44b
14
44a
46b
46a
102
118
116
114
12
51
10
26b
26a
84
66
52b
52a
16
68
82
42b
42a
58b
58a
47b
47a
40b
40a
54b
54a
56
57
18
80
70
72
74
53
90a
88b
90b
88a
92b
92a
94b
94a
24b
24a
86b
39b
86a
37b
39a
37a
32b
22b
20
22a
32a
36b
36a
35b
35a
33a
34b
33b
28
34a 78
64
120
CALIBRATION
122
SPEED
124
76
Up
126
DOWN
128
START STOP
80

95
14
44b
46b
102
12
10
118
116
114
26b
132
142
140
74
144
138
16
52b
16
56
134
47b
48
80
130
18
54b
88b
24b
37b
86b
39b
35b
36b
32b
28
22b
30b 138
142
146
140
152
148
154
156
156
144
150
158

95
14
44b
46b
102
12
10
118
26b
132
116
114
142
140
74
144
138
52b
136
134
16
56
47b
48
80
18
54b
130
88b
24b
32b
86b
37b
22b
39b
35b
36b
28
30b

CONTINUOUS PASSIVE MOTION DEVICE FOR REHABILITATION OF THE ELBOW OR SHOULDER

TECHNICAL FIELD

The present invention relates generally to continuous passive motion devices for rehabilitation of joints or soft tissue and more particularly to a continuous passive motion device having specific application to rehabilitation of the elbow or shoulder.

BACKGROUND OF THE INVENTION

The proliferation of relatively non-invasive arthroscopic surgical procedures to repair joint and soft tissue injuries and ailments has significantly reduced the duration of post-operative hospital stays for patients of orthopedic surgeries. In many cases the arthroscopic surgical procedures have eliminated altogether the need for post-operative hospital stays. As a result, the bulk of post-operative recovery time from arthroscopic surgical procedures is typically spent in the home. The patient benefits from the familiar surroundings of the home, but usually lacks continuous access to a health care practitioner, which a hospital is able to provide. Nevertheless, it is generally incumbent that the patient receive immediate rehabilitative treatment following a surgical procedure on a joint or soft tissue, particularly when the joint or soft tissue is associated with the elbow or shoulder. The object of the rehabilitative treatment is to restore full range of motion to the involved joint, such as the elbow or shoulder, as soon as possible after a surgical procedure. Such rehabilitative treatments commonly include range of motion exercises which involve controlled movement of the arm without bearing substantial weight or placing an excessive force load on the elbow or shoulder. Unfortunately, the patient often cannot effectively perform such range of motion exercises without external assistance.

Automated motor-driven devices have been developed to assist post-operative patients when performing range of motion exercises with the goal of rehabilitating a joint and restoring range of motion to the joint in the absence of direct assistance from a health care practitioner. Such devices are termed continuous passive motion devices. For example, a continuous passive motion device for rehabilitation of the shoulder is disclosed in U.S. Pat. No. 5,179,939 to Donovan et al. The device moves the arm through a range of motion to simulate operation of the soft tissue and joint associated with the shoulder. It is a stated objective of the continuous passive motion device disclosed in U.S. Pat. No. 5,179,939 to Donovan et al. to allow the involved shoulder to follow a natural anatomical range of motion when the associated arm is moved through the range of motion. Nevertheless, the continuous passive motion device of U.S. Pat. No. 5,179,939 is relatively ineffective for this intended purpose because the linkage between the arm holder and drive motor is rigid, which limits the adaptability of the device to the varied anatomies and treatment requirements of each different patient. Furthermore, the continuous passive motion device of U.S. Pat. No. 5,179,939 requires careful anatomical alignment of the arm holder with the arm of the patient and strict monitoring of the motorized external force loads applied to the shoulder via the arm to prevent injury to the shoulder during rehabilitation thereof. Accordingly, the device is relatively complex for an inexperienced user to properly set up and operate, thereby requiring professional oversight which negates the goal of unassisted treatment.

As such, it is an object of the present invention to provide a continuous passive motion device for rehabilitation of a shoulder or elbow which is relatively simple to set up and operate, yet which is adaptable to a variety of patient anatomies and treatment requirements. More particularly, it is an object of the present invention to provide a continuous passive motion device for rehabilitation of a shoulder or elbow which is readily adaptable to different patient anatomies without requiring careful anatomical alignment of the device with the elbow or shoulder. It is a further object of the present invention to provide such a continuous passive motion device which can apply a motorized force to the elbow or shoulder for range of motion exercise thereof with a relatively low risk of injury. It is still another object of the present invention to provide such a continuous passive motion device which can be effectively operated by a patient lacking any specific medical knowledge, skill or experience with little or no oversight by a health care practitioner. It is yet another object of the present invention to provide such a continuous passive motion device which is fully self-contained and portable so that the device can be used by the patient in the home or other normal locales.

These objects and others are accomplished in accordance with the invention described hereafter.

SUMMARY OF THE INVENTION

The present invention is a passive motion device for rehabilitative treatment of an elbow or shoulder. The passive motion device includes a spool rotationally displacable in a first direction or a second direction, a motor linked with the spool which effects motorized rotational displacement of the spool, a cord suspended from the spool by a variable extension length which increases when the spool is rotationally displaced in the first direction and decreases when the spool is rotationally displaced in the second direction, and an arm harness associated with the cord. The passive motion device also includes a controller in communication with the motor. The controller retains upper and lower operational limits of the motor corresponding to upper and lower rotational displacement limits of the spool and maintains the motorized rotational displacement of the spool within the upper and lower rotational displacement limits.

The passive motion device further includes a user interface in communication with the controller. The user interface has means for entering the upper and lower operational limits of the motor into the controller for retention by the controller. The user interface also has means for displaying instantaneous operational positions of the motor, which are between the upper and lower operational limits of the motor and are expressed as position data of the elbow or shoulder. The upper and lower operational limits are preferably entered into the controller in response to the position data of the elbow or shoulder displayed by the user interface. The passive motion device additionally includes a frame providing free-standing support for the spool and motor. The frame has an expanded operating configuration and a relatively more compact transport or storage configuration. The frame is transitionable between the operating configuration and the transport or storage configuration by folding. The frame also has one or more rotational wheels for support and transport of the device when the frame is in the transport or storage configuration.

In accordance with an alternate embodiment, the passive motion device of the present invention includes a motorized winch, a cord engaging the winch, which has a variable extension length increasing when the winch lets out the cord and decreasing when the winch draws in the cord, and means for suspending an arm from the cord. The passive motion device also includes a controller in communication with the motorized winch. The controller retains upper and lower operational limits of the motorized winch corresponding to upper and lower limits of the variable extension length and maintains the variable extension length within the upper and lower limits. The passive motion device further includes a user interface in communication with the controller. The user interface has means for entering the upper and lower operational limits of the motorized winch into the controller for retention by the controller and has means for displaying instantaneous operational positions of the motorized winch, which are between the upper and lower operational limits and are expressed as position data of the elbow or shoulder. The upper and lower operational limits of the motorized winch are preferably entered into the controller in response to the position data of the elbow or shoulder displayed by the user interface.

In accordance with another alternate embodiment, the passive motion device of the present invention includes a spool and a motor operable in a first drive direction or a second drive direction. The motor drives the spool in a first rotational direction when operating in the first drive direction and drives the spool in a second rotational direction when operating in the second drive direction. A cord is coiled on the spool and suspended from the spool. The cord has a variable extension length increasing when the motor drives the spool in the first rotational direction and decreasing when the motor drives the spool in the second rotational direction. The passive motion device also includes a controller retaining selectable limits of drive direction. The controller automatically reverses the drive direction of the motor from the first drive direction to the second drive direction or from the second drive direction to the first drive direction when a selected limit of drive direction is achieved corresponding to a given value of the extension length.

The present invention is also a method for rehabilitative treatment of an elbow or shoulder. In accordance with the treatment method, a cord is suspended from a motorized winch and an arm of a patient is suspended from a suspension point on the cord away from the motorized winch. The motorized winch is activated to displace the suspension point on the cord in accordance with a plurality of repetitive treatment cycles. Each treatment cycle displaces the suspension point from a lower treatment limit to an upper treatment limit and back to the lower treatment limit. The upper and lower treatment limits are entered and stored in a controller in communication with the motorized winch. The upper treatment limit corresponds to a maximum angular elevation of the shoulder and the lower treatment limit corresponds to a minimum angular elevation of the shoulder. The controller is calibrated by displacing the suspension point until the shoulder reaches a known angular elevation and storing the known angular elevation into the controller as a reference angular elevation.

The present invention will be further understood from the drawings and the following detailed description.

DESCRIPTION OF PREFERRED EMBODIMENTS

Figure 1:
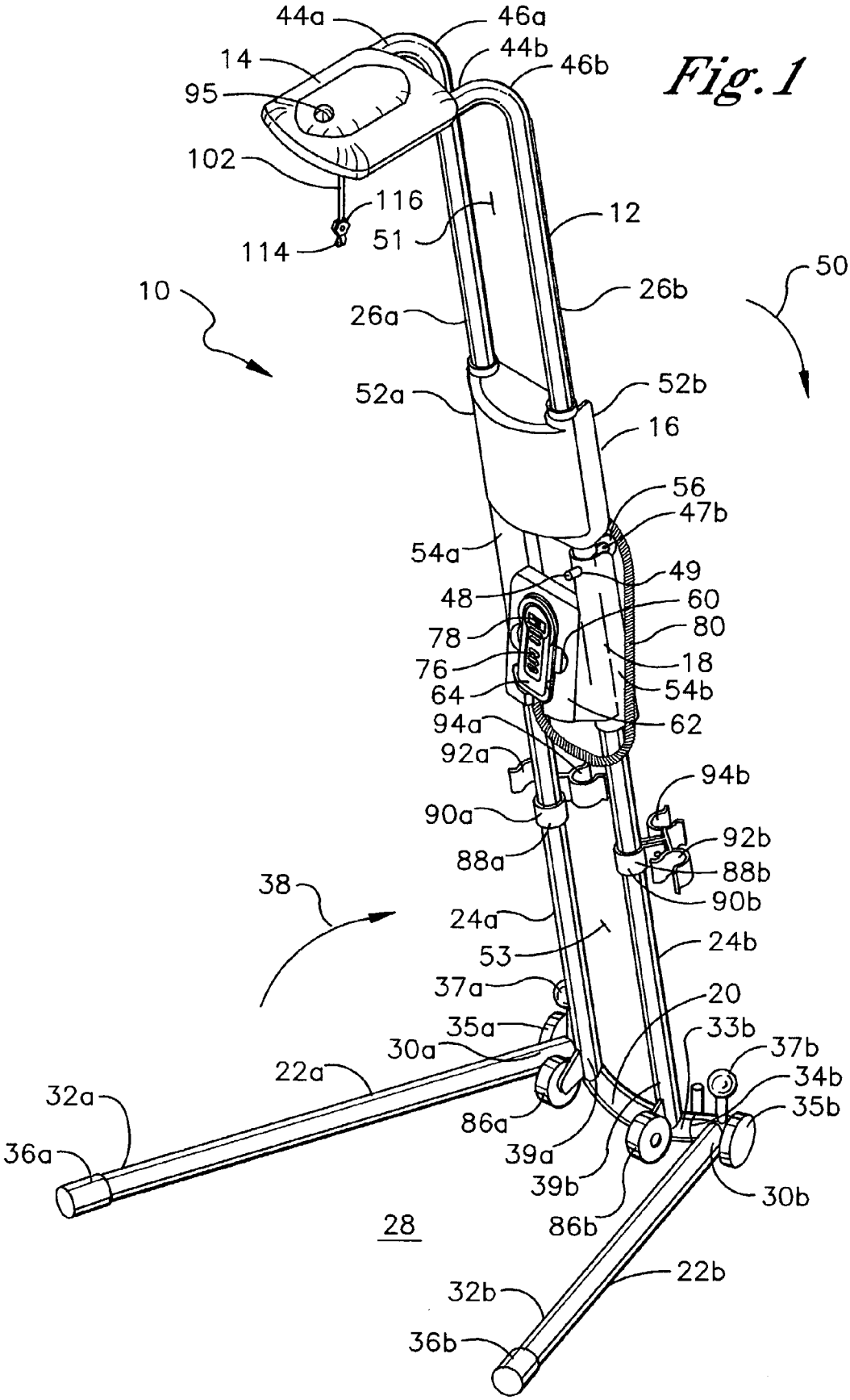
FIG. 1 is a perspective view of a continuous passive motion device of the present invention in an expanded operating configuration.
Figure 2:
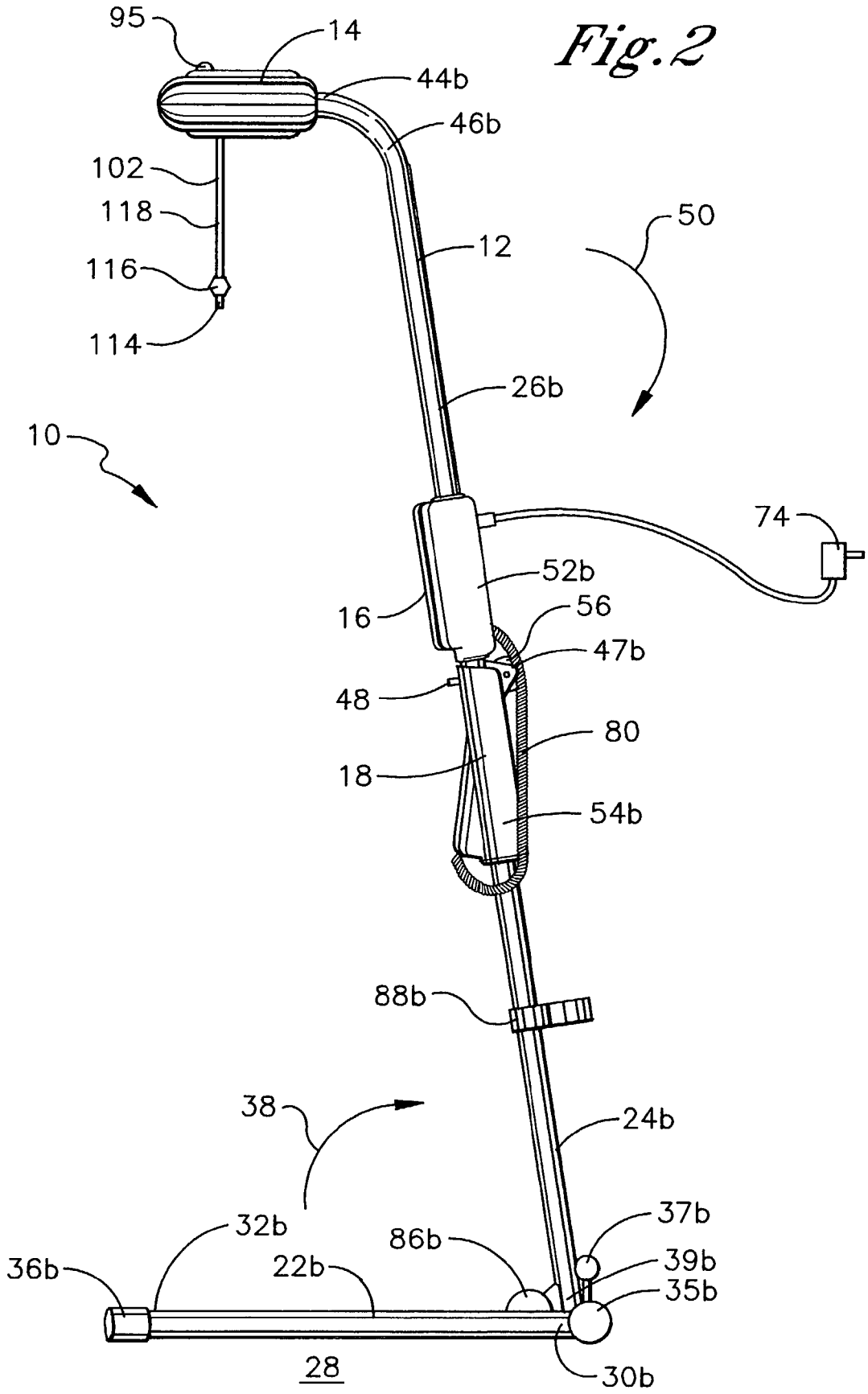
FIG. 2 is an elevational side view of the continuous passive motion device of FIG. 1.
Figure 3:
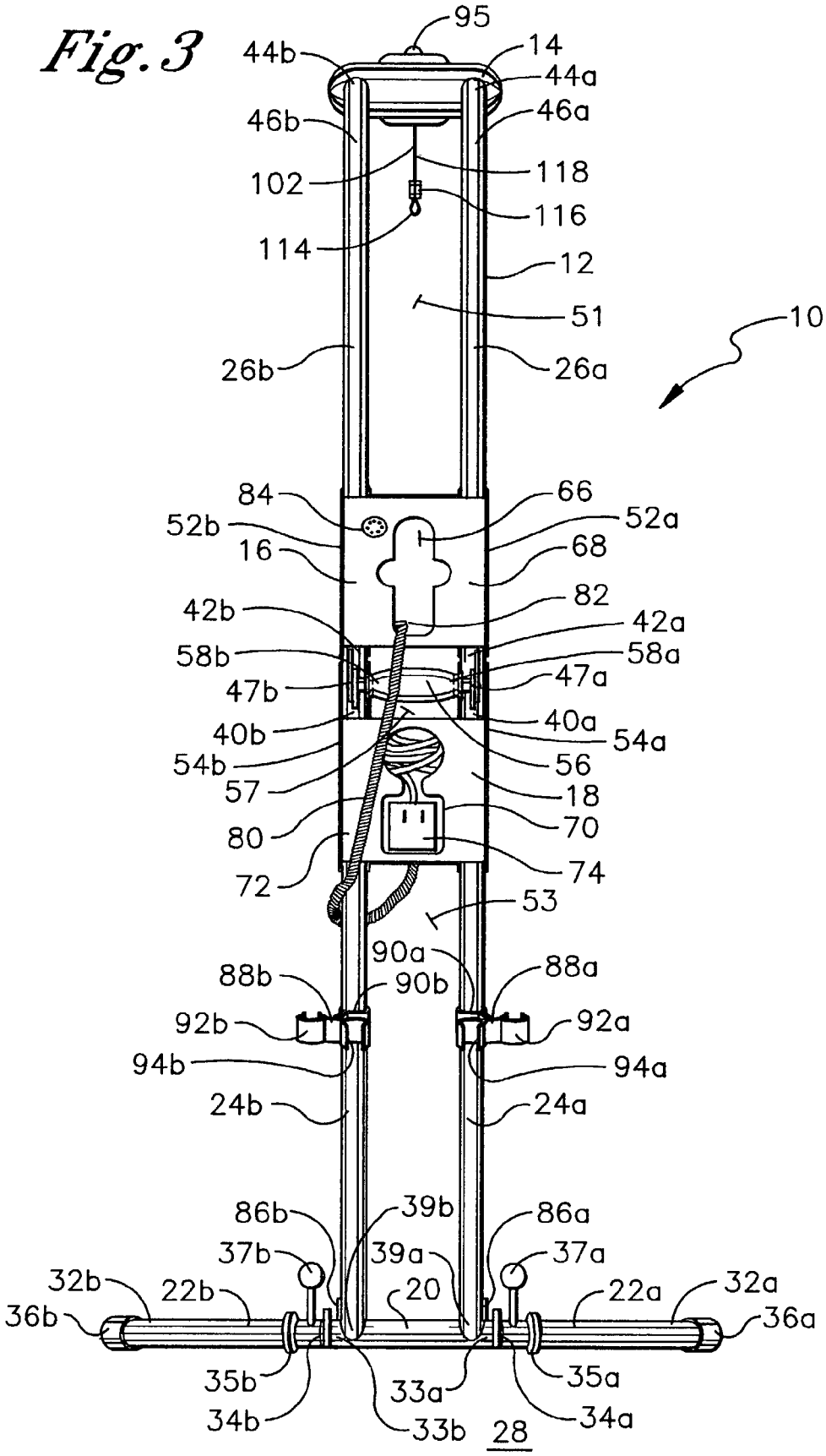
FIG. 3 is an elevational rear view of the continuous passive motion device of FIG. 1.

Referring to FIGS. 1–3, an embodiment of a continuous passive motion (CPM) device of the present invention is shown in an expanded operating configuration and generally designated 10. The CPM device 10 comprises a foldable frame 12, which provides freestanding support for a winch housing 14, a controller housing 16, and a component retention housing 18. The frame 12 is fabricated from a lightweight high-strength material, such as a metal, and preferably a tubular steel. The frame 12 has an arcuate cross member 20, a pair of substantially identical first and second stabilizers 22*a*, 22*b*, a pair of substantially identical first and second lower uprights 24*a*, 24*b*, and a pair of substantially identical first and second upper uprights 26*a*, 26*b*. The relative terms "lower" and "upper" are used herein with reference to a horizontal support surface 28 for the frame 12, such as a flat floor, which is not an element of the CPM device 10. "Lower" is closer to the support surface 28 while "upper" is further from the support surface 28.

The cross member 20, stabilizers 22*a*, 22*b*, and support surface 28 are all aligned in substantially the same common horizontal plane. Each stabilizer 22*a*, 22*b* has a straight rod-like geometry with a first end 30*a*, 30*b* and a corresponding second end 32*a*, 32*b*, respectively. The first end 30*a* of the first stabilizer 22*a* is rotationally connected to a first end 33*a* of the cross member 20 by means of a first stabilizer hinge 34*a* and the first end 30*b* of the second stabilizer 22*b* is correspondingly rotationally connected to a second end 33*b* of the cross member 20 by a second stabilizer hinge 34*b*. The first end 30*a* also has a first circular bumper 35*a* fixably mounted thereon and the second end 30*b* similarly has a second circular bumper 35*b* fixably mounted thereon. The circular bumpers 35*a*, 35*b* are formed from a plastic or elastomeric material, which is softer than the material of the frame 12.

The stabilizers 22*a*, 22*b* extend away from the same side of the cross member 20 within the common horizontal plane of alignment. The second ends 32*a*, 32*b* of the stabilizers 22*a*, 22*b* are free ends which are disengaged from the remainder of the frame 12. The stabilizers 22*a*, 22*b* splay apart from one another as each extends in the direction of the second end 32*a*, 32*b* so that the second ends 32*a*, 32*b* are farther from one another than are the first ends 30*a*, 30*b*. A first end cap 36*a* is formed from a plastic or elastomeric material, which is softer than the material of the frame 12, and is press fitted over the second end 32*a* of the first stabilizer 22*a*. A corresponding second end cap 36*b* is press fitted over the second end 32*b* of the second stabilizer 22*b*. The cross member 20 and stabilizers 22*a*, 22*b* provide a stable base for the CPM device 10 with the circular bumpers 35*a*, 35*b* and end caps 36*a*, 36*b* functioning as the feet of the base. Thus, the CPM device 10 is fully operational on the relatively flat horizontal support surface 28 without requiring any additional supporting structure and with little risk of inadvertent unintentional tipping.

The stabilizer hinges 34*a*, 34*b* are selectively transitionable between a locked condition and an unlocked condition by means of first and second lock releases 37*a*, 37*b*, respectively. Each lock release 37*a*, 37*b* is a ball-shaped handle covered with a material identical or similar to the material of the circular bumpers 35*a*, 35*b*. Each lock release 37*a*, 37*b* is spring-biased toward a retracted position and each stabilizer hinge 34*a*, 34*b* is in the locked condition when the respective lock release 37*a*, 37*b* is retracted in response to the spring-biasing force. The locked condition impedes substantial rotation of the stabilizers 22*a*, 22*b* about the stabilizer hinges 34*a*, 34*b* relative to the cross-member 20 and lower uprights 24*a*, 24*b*. Each stabilizer hinge 34*a*, 34*b* is transitioned to the unlocked condition when a sufficient manual force is applied to the respective lock release 37*a*, 37*b* to overcome the spring-biasing force and displace the lock release 37*a*, 37*b* to an extended position. When the lock release 37*a*, 37*b* is in the extended position, the stabilizers 22*a*, 22*b* are free to rotate backward and upward relative to the cross-member 20 and lower uprights 24*a*, 24*b* in correspondence with a directional arrow 38.

The relative terms "backward" and "forward" are used herein with reference to the direction in which the stabilizers 22*a*, 22*b* extend from the cross member 20. "Backward" is away from the direction of stabilizer extension, while "forward" is toward the direction of stabilizer extension. The relative terms "downward" and "upward" are used herein with reference to the horizontal support surface 28, wherein "downward" is toward the support surface 28, while "upward" is away from the support surface 28. The terminus of backward and upward rotation is reached when the stabilizers 22*a*, 22*b* are in substantially side-by-side linear alignment with the lower uprights 24*a*, 24*b*, respectively, i.e., the stabilizers 22*a*, 22*b* and lower uprights 24*a*, 24*b* reside in substantially the same plane. Rotation of the stabilizers 22*a*, 22*b* about the stabilizer hinges 34*a*, 34*b* is described further hereafter with respect to a folded transport or storage configuration of the CPM device 10.

Each lower upright 24*a*, 24*b* has a straight rod-like geometry with a first end 39*a*, 39*b* and a second end 40*a*, 40*b*, respectively. The first end 39*a*, 39*b* of each lower upright 24*a*, 24*b* is fixably attached to the top of the cross member 20 at points proximal to the ends 33*a*, 33*b*, respectively, of the cross member 20. The lower uprights 24*a*, 24*b* extend substantially parallel to one another in an approximate vertical direction away from the top of the cross member 20. However, the lower uprights 24*a*, 24*b* are preferably not oriented at an exact 90° angle to the common horizontal plane of the cross member 20, stabilizers 22*a*, 22*b* and support surface 28. Instead the lower uprights 24*a*, 24*b* diverge a deviation angle away from 90°, e.g., 5 to 20°, so that the lower uprights 24*a*, 24*b* extend at least somewhat over the stabilizers 22*a*, 22*b*.

Each upper upright 26*a*, 26*b* has a first end 42*a*, 42*b* and a second end 44*a*, 44*b*, respectively, with a first elbow 46*a* positioned in the first upper upright 26*a* between the ends 42*a*, 44*a* of the first upper upright 26*a* and a corresponding second elbow 46*b* positioned in the second upper upright 26*b* between the ends 42*b*, 44*b* of the second upper upright 26*b*. The second end 40*a* of the first lower upright 24*a* is rotationally connected to the first end 42*a* of the first upper upright 26*a* by means of a first upright hinge 47*a* and the second end 40*b* of the second lower upright 24*b* is correspondingly rotationally connected to the first end 42*b* of the second upper upright 26*b* by means of a second upright hinge 47*b*. The upper uprights 26*a*, 26*b* extend substantially parallel to one another away from the lower uprights 24*a*, 24*b* in an arcuate path to the winch housing 14 with the second end 44*a*, 44*b* of each upper upright 26*a*, 26*b* fixably attached to the winch housing 14. The arcuate path of the upper uprights 26*a*, 26*b* is imparted by the elbows 46*a*, 46*b*, respectively. Each elbow 46*a*, 46*b* arcs at approximately 90° minus the deviation angle of the lower uprights 24*a*, 24*b* so that the plane in which the winch housing 14 resides is substantially parallel to the common horizontal plane of the cross member 20, stabilizers 22*a*, 22*b* and support surface 28.

The distance between the winch housing 14 and the support surface 28, i.e., the height of the CPM device 10, is preferably sufficient to provide clearance between the winch housing 14 and the fully upraised arm of a patient, who is either seated on a seat or reclining on a bed or similar reclining support beneath the winch housing 14. Although such a patient support is not an element of the CPM device 10, a cooperative patient support is preferably made available to the patient during operation of the CPM device 10 described hereafter. The patient support enables the patient to utilize the CPM device 10 while in a seated or reclining position.

The required height of the CPM device 10 varies as a function of the dimensions of the patient and the position of the patient relative to the CPM device 10. A CPM device having a height of 5 feet is usually sufficient for normal operation, but it is preferable to provide an added clearance margin to the height of the CPM device in the event it is necessary to accommodate an unusually large patient. As such, the height of the CPM device 10 is typically in a range of 5 to 8 feet. Although it is not generally practical, in some instances it may desirable to extend the height of the CPM device 10 beyond the above-recited range so that the patient can utilize the CPM device 10 from a standing position beneath the CPM device 10.

The upright hinges 47*a*, 47*b* are selectively transitionable between a locked condition and an unlocked condition by means of a lock assembly having a spring-biased lock button 48 and a lock aperture 49 formed in the component retention housing 18. The lock button 48 is spring-biased forward toward an extended position and the lock aperture 49 is sized to permit free movement of the lock button 48 therethrough. The upright hinges 47*a*, 47*b* are in the locked condition when the spring-biasing force causes the forward extended lock button 48 to reside in the lock aperture 49, thereby impeding substantial rotation of the upper uprights 26*a*, 26*b* about the upright hinges 47*a*, 47*b* relative to the lower uprights 24*a*, 24*b*. The upright hinges 47*a*, 47*b* are transitioned to the unlocked condition when the lock button 48 is manually depressed backward counter to the spring-biasing force, thereby pushing the lock button 48 back out of the lock aperture 49 and enabling the upper uprights 26*a*, 26*b* to rotate freely backward and downward relative to the lower uprights 24*a*, 24*b* in correspondence with a directional arrow 50. The terminus of backward and downward rotation is reached when the upper uprights 26*a*, 26*b* are in substantially side-by-side linear alignment with the lower uprights 24*a*, 24*b*, respectively, i.e., the lower uprights 24*a*, 24*b* and upper uprights 26*a*, 26*b* reside in substantially the same plane. Rotation of the upper uprights 26*a*, 26*b* about the upright hinges 47*a*, 47*b* is described further hereafter with respect to a folded transport or storage configuration of the CPM device 10.

The controller housing 16 extends across a space 51 between the upper uprights 26*a*, 26*b*, with a first side 52*a* of the controller housing 16 fixably attached to the first upper upright 26*a* and a second side 52*b* of the controller housing 16 fixably attached to the second upper upright 26*b*. The component retention housing 18 similarly extends across a space 53 between the lower uprights 24*a*, 24*b* with a first side 54*a* of the component retention housing 18 connected to the first lower upright 24*a* and a second side 54*b* of the component retention housing 18 connected to the second lower upright 24*b*. A transport handle 56 extends across a space 57 between the upright hinges 47*a*, 47*b* with a first end 58*a* of the transport handle 56 fixably attached to the first upright hinge 47*a* and a second end 58*b* of the transport handle 56 fixably attached to the second upright hinge 47*b*. As such the transport handle 56 is laterally positioned between the controller housing 16 and component retention housing 18. The transport handle 56 is a hand grip having utility during manual transport or repositioning of the CPM device 10 in a manner described hereafter.

A first user interface receptacle 60 is formed in a front face 62 of the component retention housing 18, which is sized to receive and releasably retain a user interface 64, when the user interface 64 is in an active state during patient-controlled operation of the CPM device 10. A second user interface receptacle 66 is formed in a back face 68 of the controller housing 16 which is sized to receive and releasably retain the user interface 64 (not shown), when the user interface 64 is in an active state during health care practitioner-controlled operation of the CPM device 10 or in an inactive state during transport or storage of the CPM device 10. Complementary magnets (not shown) may be positioned on the backside of the user interface 64 and in the user interface receptacles 60, 66 to facilitate releasable retention of the user interface 64 in the user interface receptacles 60, 66. A storage receptacle 70 is formed in a back face 72 of the component retention housing 18 which is sized to receive and releasably retain a power transformer and cord assembly 74, when the assembly 74 is disconnected in an inactive state during transport or storage of the CPM device 10.

The user interface 64 is a handset having an input keypad 76 and an output display 78 on the front face of the user interface 64 described in greater detail hereafter. A communications cord 80 extends between the user interface 64 and a communications port 82 in the back face 68 of the controller housing 16 which communicates with an electrically powered controller (not shown) housed within the controller housing 16. The controller includes a conventional microprocessor, programmable memory and read-only memory. The communications cord 80 enables two-way communication between the user interface 64 and the controller. The power transformer and cord assembly 74 extends from a power port 84 in the back face 68 of the controller housing 16 to an electrical power source (not shown), such as a conventional household electrical power outlet. The power port 84 is in communication with the controller, which enables the power transformer and cord assembly 74 to transmit a desired electrical power input to the controller from the electrical power source for operation of the controller. The controller also distributes electrical power to the user interface 64 and a winch (not shown in FIGS. 1–3) positioned in the winch housing 14 for operation thereof.

A pair of first and second transport wheels 86*a*, 86*b* are mounted on the base of the frame 12. In particular, the transport wheels 86*a*, 86*b* are attached to the first end 39*a*, 39*b* of the lower uprights 24*a*, 24*b*, respectively, proximal to the points where the first ends 39*a*, 39*b* are fixably attached to the cross member 20. The transport wheels 86*a*, 86*b* are inoperable when the CPM device 10 is in the operating configuration, because the transport wheels 86*a*, 86*b* are essentially free from contact with the support surface 28. However, the transport wheels 86*a*, 86*b* become operable when the CPM device 10 is reconfigured to the transport or storage configuration in a manner described hereafter.

A pair of first and second retention members 88*a*, 88*b* are attached to the first and second lower uprights 24*a*, 24*b*, respectively. Each retention member 88*a*, 88*b* is formed from a semi-flexible plastic material and includes a ring 90*a*, 90*b*, a first retention clip 92*a*, 92*b*, and a second retention clip 94*a*, 94*b*. Each ring 90*a*, 90*b* fixably secures the retention member 88*a*, 88*b* to the respective lower upright 24*a*, 24*b*. Each first retention clip 92*a*, 92*b* has a horseshoe configuration, which releasably retains the stabilizer 22*a*, 22*b* proximal to the respective lower upright 24*a*, 24*b*, when the terminus of backward and upward rotation of the stabilizers 22*a*, 22*b* is reached. Each second retention clip 94*a*, 94*b* has a similar or identical horseshoe configuration, which releasably retains the respective upper upright 42*a*, 42*b* in side-by-side linear alignment with the respective lower upright 24*a*, 24*b*, when the terminus of backward and downward rotation of the lower uprights 24*a*, 24*b* is reached.

Figure 4:
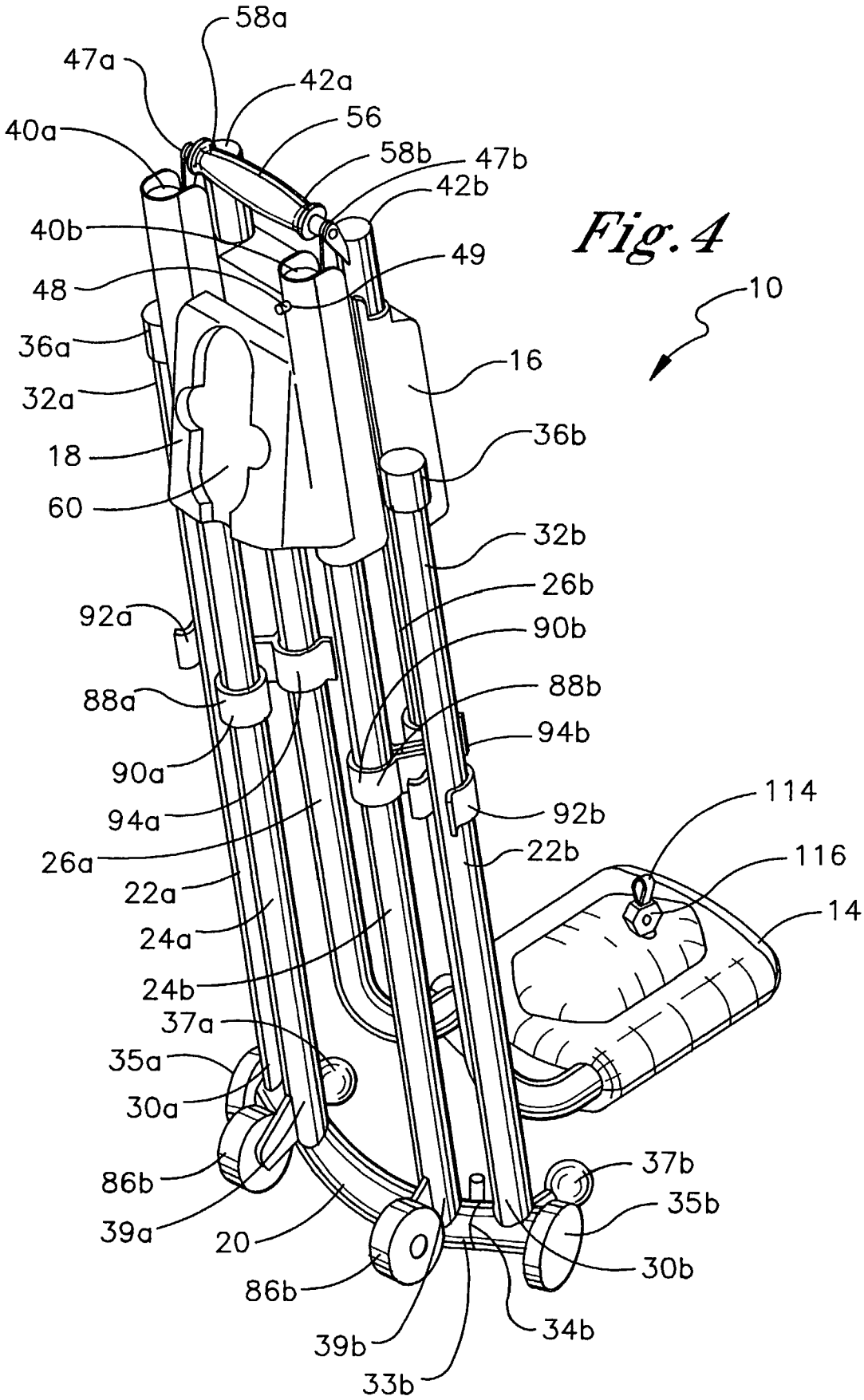
FIG. 4 is a perspective view of the continuous passive motion device of the present invention in a folded transport or storage configuration.

Referring to FIG. 4, the CPM device 10 is shown in the folded transport or storage configuration. The transport or storage configuration is substantially more compact than the operating configuration, which facilitates transportation or storage of the CPM device 10. Conversion of the CPM device 10 from the expanded operating configuration of FIGS. 1–3 to the folded transport or storage configuration of FIG. 4 is effected by placing the user interface 64 in the second user interface receptacle 66, removing the power transformer and cord assembly 74 from the power port 84, and placing the power transformer and cord assembly 74 in the storage receptacle 70. The upright hinges 47*a*, 47*b* are unlocked by manually depressing the lock button 48 and rotating the upper uprights 26*a*, 26*b* backward and downward to the terminus of rotation. Each upper upright 26*a*, 26*b* is pressed into the corresponding second retention clip 94*a*, 94*b* to maintain the upper uprights 26*a*, 26*b* folded backward and downward in essentially the same plane as the lower uprights 24*a*, 24*b*. The stabilizer hinges 34*a*, 34*b* are unlocked by manually extending the lock releases 37*a*, 37*b* and rotating the stabilizers 22*a*, 22*b* backward and upward to the terminus of rotation. Each stabilizer 22*a*, 22*b* is pressed into the corresponding first retention clip 92*a*, 92*b* to maintain the stabilizers 22*a*, 22*b* folded backward and upward in essentially the same plane as the lower uprights 24*a*, 24*b*.

The CPM device 10 is readily manually transportable in the transport or storage configuration using the transport wheels 86*a*, 86*b*. In particular, manual transport of the CPM device 10 in the transport or storage configuration is effected by grasping the transport handle 56 and manually pivoting the lower uprights 24*a*, 24*b* forward and downward until the transport wheels 86*a*, 86*b* engage the support surface 28. The transport handle 56 is manually pulled or pushed to roll the CPM device 10 on the transport wheels 86*a*, 86*b* in a desired direction until a desired operating location is reached. When it is desired to store the CPM device 10 in the transport or storage configuration, the lower uprights 24*a*, 24*b* are manually pivoted backward and upward until the circular bumpers 35*a*, 35*b*, lock releases 37*a*, 37*b*, and an overhead bumper 95 (shown in FIGS. 1–3) engage a horizontal supporting surface such as the support surface 28. The overhead bumper 95 is positioned atop the winch housing 14 and is formed from an identical or similar material to the circular bumpers 35*a*, 35*b*. The circular bumpers 35*a*, 35*b*, lock releases 37*a*, 37*b*, and overhead bumper 95 provide a stable storage base, which enables the CPM device 10 to stand freely during storage on any relatively flat horizontal supporting surface without requiring any additional supporting structure and with little risk of inadvertent unintentional tipping.

Figure 5:
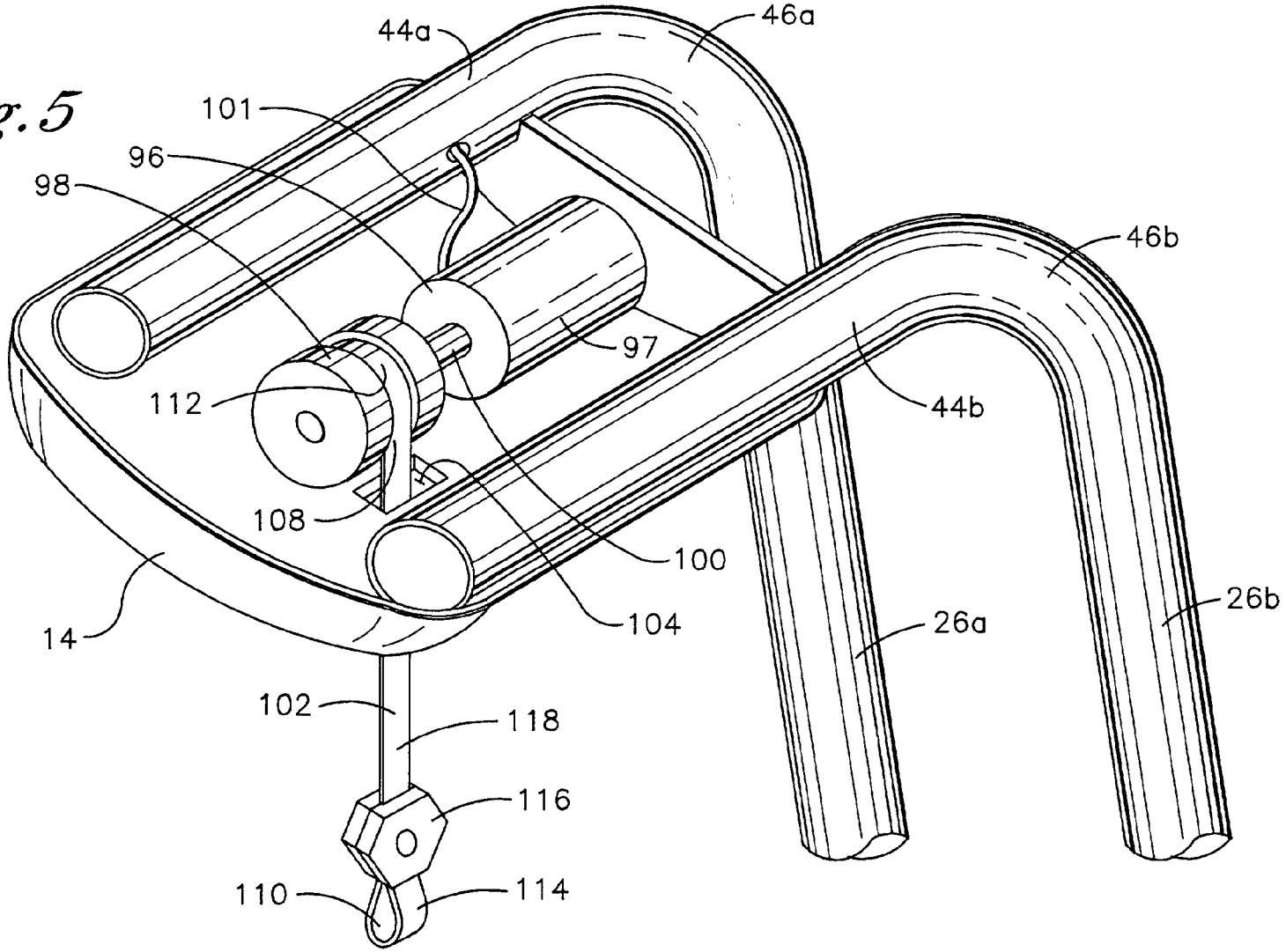
FIG. 5 is a perspective view of a winch housing utilized in the continuous passive motion device of FIG. 1, wherein the top of the winch housing is cut away to expose the winch housed therein.

Referring to FIG. 5, the winch housing 14 is shown with the top cut away to expose a winch 96 enclosed within the winch housing 14. The winch 96 generally comprises a motor 97, a spool 98 (alternately termed a reel or drum), and a drive shaft 100. The motor 97 is an electric motor which converts electrical power to rotational mechanical power. The rotational mechanical power is readily switchable between a clockwise direction of rotation and an opposite counterclockwise direction of rotation. Electrical power is supplied to the motor 97 via an electrical line 101. The electrical line 101 is threaded through the first upper upright 26*a* from the controller enclosed within the controller housing 16 to the motor 97. The drive shaft 100 is a power transmission link between the motor 97 and the spool 98, which mechanically couples the motor 97 and spool 98 and rotationally displaces the spool 98 in correspondence with rotation of the motor 97. The winch 96 is mounted in the winch housing 14 by mounting hardware which fixes the position of the winch 96 within the winch housing 14, but does impede rotational operation of the winch components 97, 98, 100. The mounting hardware is not shown in FIG. 5 for purposes of clarity, but such mounting hardware is readily within the purview of the skilled artisan.

A suspension cord 102 (also shown in FIGS. 1–4) is freely suspended downwardly under the force of gravity from the spool 98 through a slot 104 in the winch housing 14. The slot 104 is sized so that it does not substantially impair up and down displacement of the suspension cord 102 therethrough as described hereafter. The suspension cord 102 is broadly defined herein as a relatively slender, elongated length of a material or combination of materials. The suspension cord 102 is not limited to a specific cross-sectional configuration, but may include structures having a round cross-section, such as a wire, or a rectangular cross-section, such as a strap or ribbon. Nor is the suspension cord 102 limited to a specific fabrication, but may be fabricated as a single continuous strand of a homogeneous material, such as a homogenous strap or wire, or as multiple interwoven strands of one material or of different materials, such as a braided cable or rope. Although it is apparent that suspension cords with differing degrees of flexibility may satisfy the criteria set forth above, in all cases a suspension cord having utility herein is characterized as being flexible, and preferably non-stretchable, when subjected to the dead weight of a patient's arm. In a preferred embodiment, the suspension cord 102 is a continuous homogeneous nylon strap having an approximately rectangular cross-section and which is flexible and essentially non-stretchable.

Figure 7:
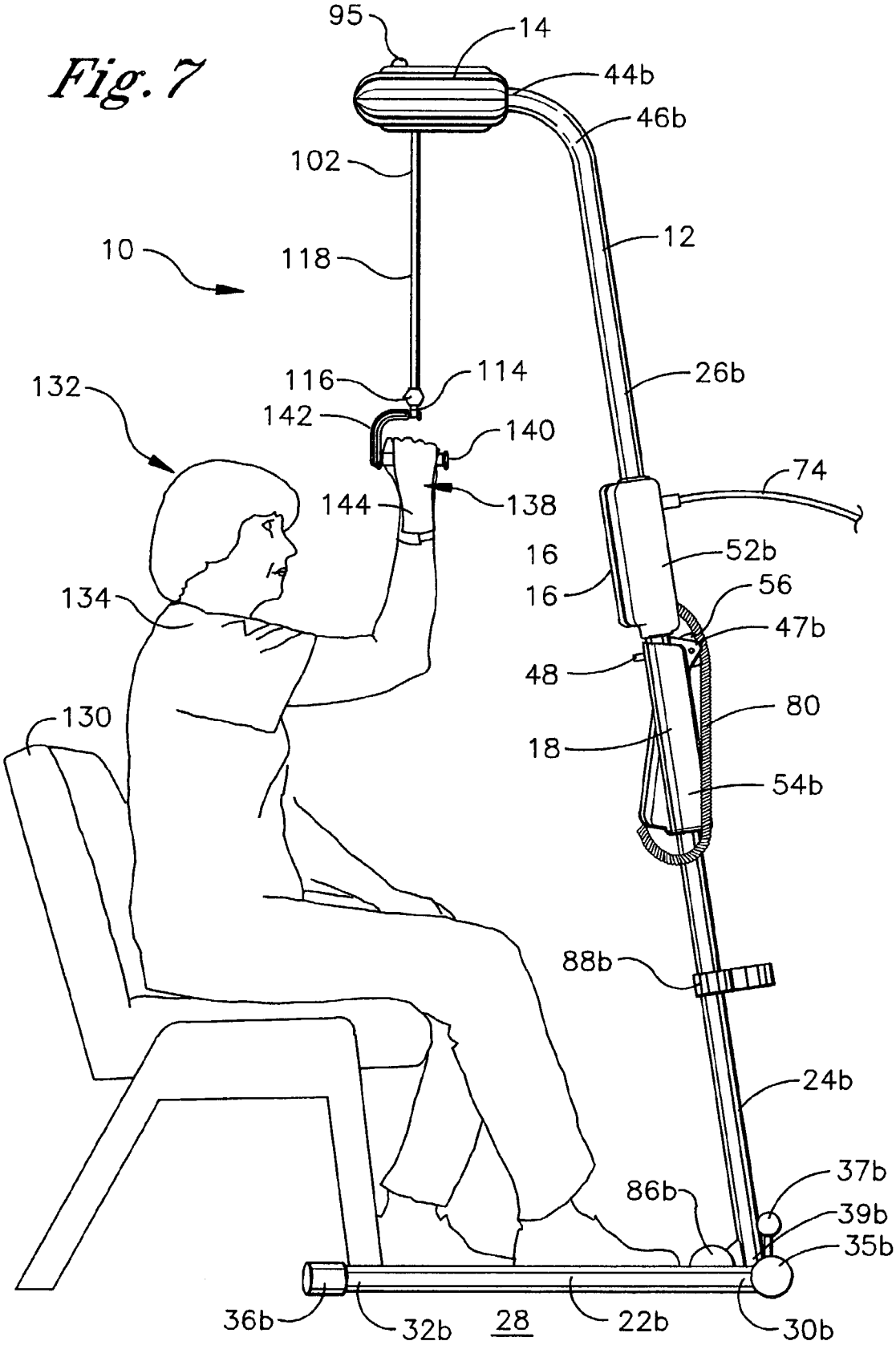
FIG. 7 is an elevational side view of the continuous passive motion device of FIG. 1, wherein a patient has a straight-on seated orientation relative to the device to enable continuous passive motion flexion treatment of the shoulder.

The suspension cord 102 has a length which, at a minimum, is sufficient to extend from the winch housing 14 to the hand of a patient having the associated shoulder at about 90° of elevation when the patient is seated beneath the winch housing 14 and the CPM device 10 is in the operating configuration, for example, as shown in FIG. 7. The suspension cord 102 more preferably has a length which is sufficient to extend from the winch housing 14 to the hand of a patient having the associated shoulder at substantially 0° of elevation when the patient is seated beneath the winch housing 14. Most preferably, the suspension cord 102 has an even longer length to provide an added margin in the event it is necessary to accommodate an unusually small or large patient and/or to maintain a substantial length of the suspension cord 102 coiled on the spool 98 at all times during operation of the CPM device 10.

A plurality of locations are specified on the suspension cord 102 for purposes of describing operation of the CPM device 10 hereafter. The specified locations include a spool engagement point (not shown), a spool disengagement point 108 and an arm engagement point 110. The spool engagement point is a location on the suspension cord 102 where the suspension cord 102 is attached to and/or first engages the spool 98. The spool engagement point is preferably at a first end of the suspension cord 102. The suspension cord 102 is wound around the spool 98 from the spool engagement point in a relatively tight coil 112 until the spool disengagement point 108 is reached. Although the suspension cord 102 is preferably fixably attached to the spool 98 at the spool engagement point, it is not essential to the present invention, insofar as the tension of the coil 112 may be sufficient to maintain the spool engagement point in engagement with the spool 98 at all times during operation of the CPM device 10.

The spool disengagement point 108 is a location on the suspension cord 102 where the suspension cord 102 departs from engagement with the spool 98. In particular, the suspension cord 102 diverges from the circular path of the coil 112 at the spool disengagement point 108 and initiates a substantially linear downward path to the arm engagement point 110. The arm engagement point 110 is a location on the suspension cord 102 where the suspension cord 102 is associated with an arm harness (shown and described below with reference to FIGS. 7–9). The arm engagement point 110 is preferably at a second end of the suspension cord 102 opposite the first end of the suspension cord 102. A preferred arm engagement point 110 includes a loop 114 formed in the suspension cord 102 by doubling the suspension cord 102 back onto itself at the arm engagement point 110 and clamping or otherwise fastening the suspension cord 102 to itself with a cord coupling 116 such as a nut and bolt pair or the like.

FIG. 5 shows the suspension cord 102 in a position of essentially full contraction, wherein nearly the entirety of the suspension cord 102 is wound onto the spool 98 and resides within the coil 112. A short segment of the suspension cord 102 including the arm engagement point 110 preferably remains external to the winch housing 14 below the slot 104 at all times to facilitate initiating operation of the CPM device 10. The cord coupling 116 is preferably too large to fit through the slot 104, which substantially prevents the arm engagement point 110 from passing through the slot 104. The segment of the suspension cord 102 which extends from the spool disengagement point 108 to the arm engagement point 110 is termed herein the extension segment 118.

Accordingly, the length of the extension segment 118, termed the extension length, is the distance between the spool 98 and an arm harness and is variable in response to rotation of the motor 97 and correspondingly to rotation of the spool 98.

Figure 6:
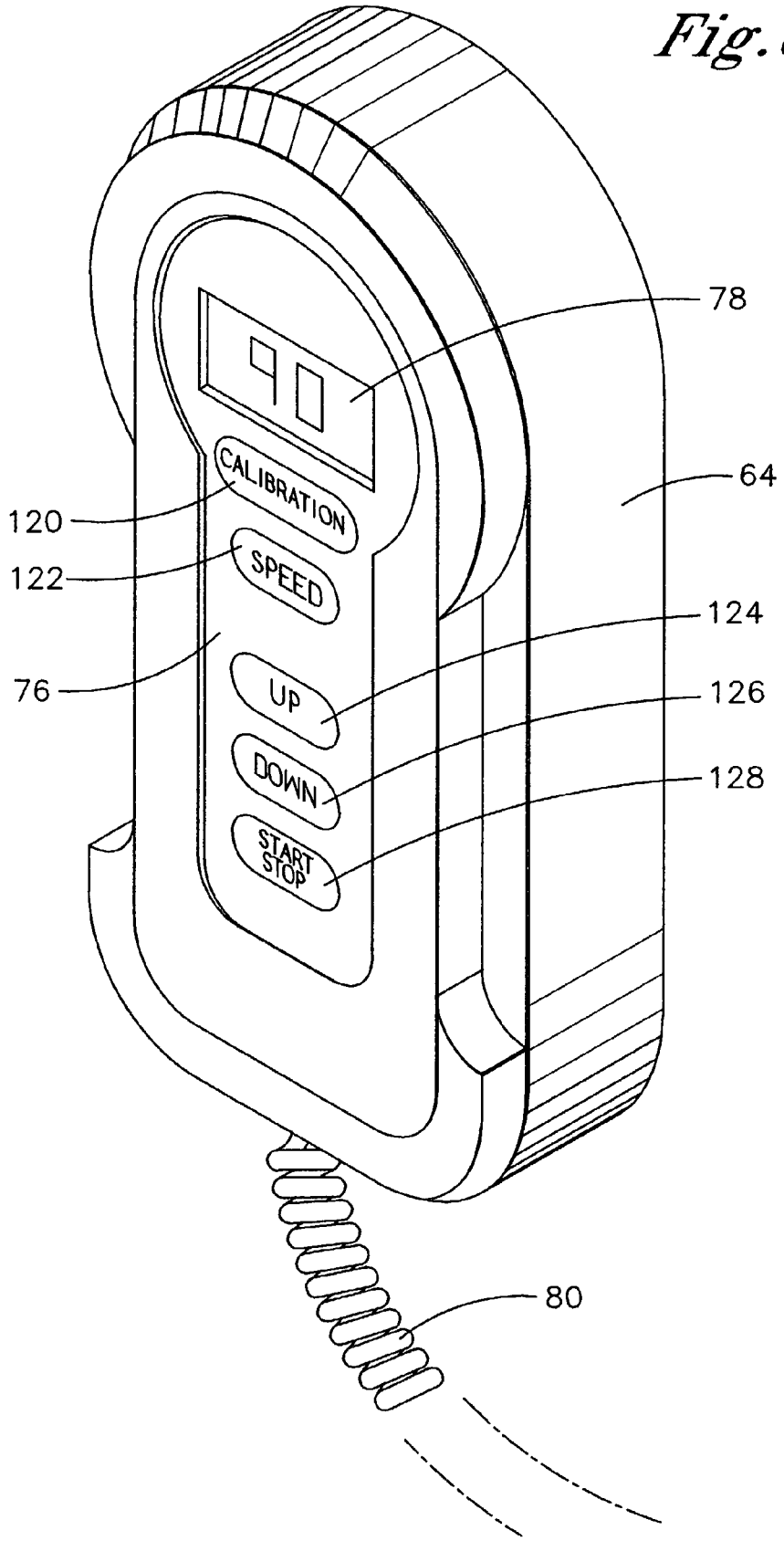
FIG. 6 is a perspective view of a user interface utilized in the continuous passive motion device of FIG. 1.

Details of the user interface 64, which includes the input keypad 76 and output display 78, are shown with reference to FIG. 6. The input keypad 76 comprises five separate function keys 120, 122, 124, 126, 128, which are responsive to manual depression. The function keys 120, 122, 124, 126, 128 may be raised enabling a user to locate the function keys by touch and may be labeled and/or color coded for function enabling a user to locate the function keys by sight. A user is defined herein as a patient or some other party, such as a health care practitioner, interacting with the user interface 64. The function key 120 is a calibration key which controls calibration of the CPM device 10. The function key 122 is a speed key which controls the displacement speed of the suspension cord 102 as it is displaced up or down. The key 124 is an up key which establishes the upward direction of cord displacement and sets the upper treatment limit. The key 126 is a down key which establishes the downward direction of cord displacement and sets the lower treatment limit. The key 128 is a start/stop key which initiates calibration of the CPM device 10 and thereafter starts or stops cord displacement. The output display 78 is a conventional visually readable display such as an LED or LCD display, which displays the angular elevation of the shoulder numerically in units of degrees once the CPM device 10 is calibrated. The angular elevation of the shoulder is defined as the angle between the upper arm and the longitudinal axis of the body.

METHODS OF OPERATION

Methods of operating the CPM device 10 in accordance with the present invention generally include two preliminary stages and a treatment performance stage. The first preliminary stage is a mechanical configuration stage, wherein the CPM device 10 is set up in the operating configuration on the support surface 28 with the suspension cord 102 preferably in the position of full contraction and the CPM device 10 fully powered. The second preliminary stage is a treatment definition stage, wherein a series of parameter setting steps are completed by manual inputs to the preprogrammed controller, which conform operation of the CPM device 10 to the specific individualized treatment requirements of a given patient. The parameter setting steps included in the treatment definition stage are a calibration step, a lower treatment limit set step, and an upper treatment limit set step. The manual inputs for the treatment definition stage may be entered by any user, for example, the patient alone or another, such as a health care practitioner, working in cooperation with the patient. Furthermore, the manual inputs may be determined in response to performance of either the involved or non-involved elbow or shoulder of the patient. The treatment performance stage is the actual rehabilitative treatment of the patient, wherein the CPM 10 device automatically executes a series of repetitive treatment cycles on the involved elbow or shoulder of the patient, subject to limited optional manual inputs. The optional manual inputs for the treatment performance stage may similarly be entered by the patient alone or by another working in cooperation with the patient, but are determined in response to performance of only the involved elbow or shoulder of the patient.

Figure 8:
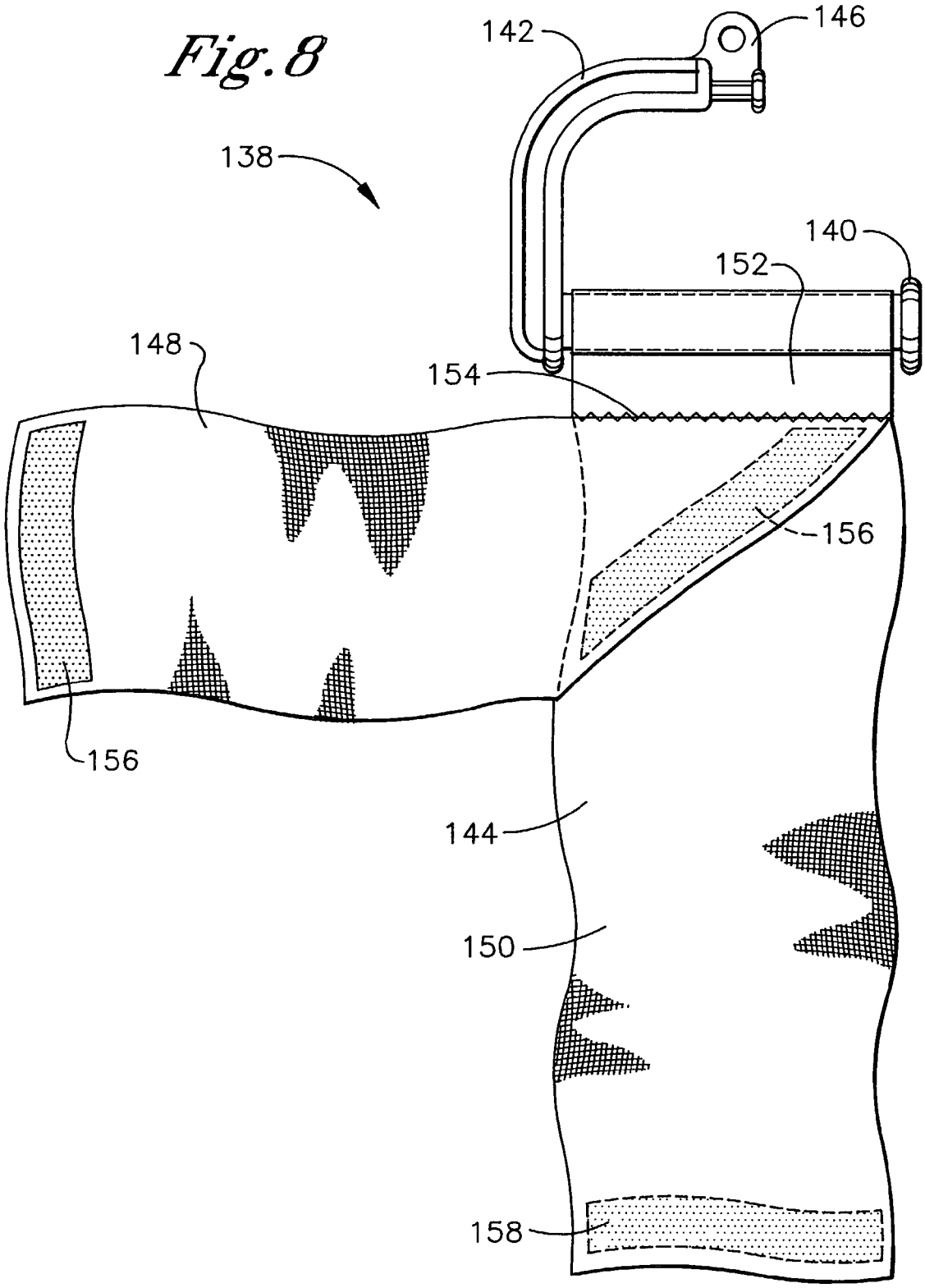
FIG. 8 is a plan view of an arm harness utilized in the continuous passive motion device of FIG. 1.
Figure 9:
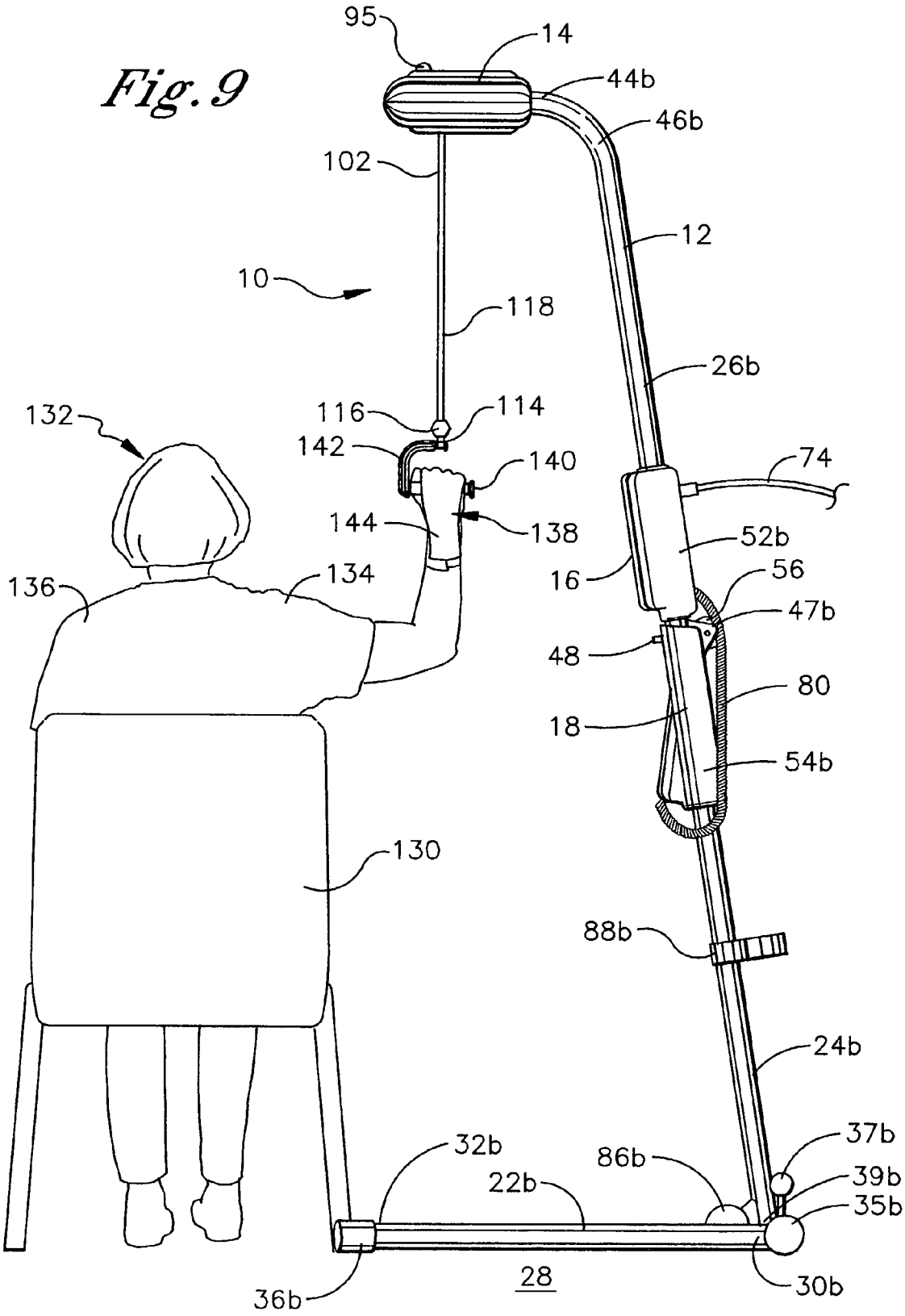
FIG. 9 is an elevational side view of the continuous passive motion device of FIG. 1, wherein a patient has a sideways seated orientation relative to the device to enable continuous passive motion abduction treatment of the shoulder.

A specific embodiment of an operating method of the present invention is described by way of example hereafter with continuing reference to FIGS. 1–3, 5 and 6 and with further reference to FIGS. 7–9. In accordance with the present embodiment, the CPM device 10 performs a continuous passive motion flexion treatment on an involved shoulder of a patient in a seated position. The method is initiated by performing the mechanical configuration stage in the manner described above with reference to FIGS. 1–3. Referring additionally to FIG. 7, the mechanical configuration stage is supplemented by positioning a patient seat 130 on the support surface 28 beneath the winch housing 14 of the CPM device 10.

The treatment definition stage positions a patient 132 on the patient seat 130 with the patient 132 directly facing the controller housing 16. As such, the patient 132 has a straight-on seated orientation relative to the CPM device 10 and an involved shoulder 134 of the patient 132, which is shown here as the right shoulder, is in approximate vertical alignment with the winch housing 14 and suspension cord 102. For purposes of illustration, the manual inputs are described hereafter as being entered by the patient 132 alone and are determined solely in response to performance of the involved shoulder 134. However, as noted above, the present invention is not limited to this embodiment. The manual inputs may alternatively be entered by another working in cooperation with the patient 132. Furthermore, the manual inputs of the treatment definition stage may alternatively be determined in response to performance of a non-involved shoulder 136 of the patient 132, which is shown here as the left shoulder, and subsequently switching to the involved shoulder 134 for the treatment performance stage.

In any case, to proceed with the present embodiment the seated patient 132 enters a manual input by momentarily depressing the start/stop key 126 on the user interface 64 to communicate an instruction to the controller via the communications cord 80. The controller responds to the instruction by transmitting electrical power to the motor 97 via the electrical line 101 which activates the motor 97 and causes the motor 97 and correspondingly the spool 98 to rotate in a clockwise direction, thereby unreeling the suspension cord 102 from the spool 98 and increasing the length of the extension segment 118. When the suspension cord 102 reaches a position of full extension or some other fixed maximum length of the extension segment 118, which is preprogrammed into the controller, the controller automatically deactivates the motor 97. The resulting position of the suspension cord 102 preferably places the loop 114 proximal to the hand associated with the involved shoulder 134 of the patient 132, which is resting at the side of the patient 132.

The CPM device 10 is further provided with an arm harness for effective operation. An arm harness is broadly defined herein as any means associated with (i.e., connected to or integral with) the suspension cord 102, which enables suspension of the arm of the patient 132 from the suspension cord 102. In general, suspension of the arm from the suspension cord 102 is effected by connecting the arm harness associated with the suspension cord 102 and the arm associated with the involved shoulder 134. An arm harness, which is integral with the suspension cord 102, may simply be an expansion of the loop 114 so that the expanded loop is large enough to receive some part of the arm of the patient 132. The term "arm" as generally used herein, unless specifically stated otherwise, is any part of the body extending past the shoulder from the trunk, including the upper arm, elbow, lower arm, wrist, hand and fingers. Alternatively, an arm harness, which is connected to the suspension cord 102, is a structure separate from the suspension cord 102, for example, a handle. Such an arm harness is fixably or releasably connected to the suspension cord 102 and can be actively grasped by the hand of a patient or passively coupled with some part of the arm of the patient.

A preferred arm harness 138, shown and described below with reference to FIG. 8, is a separate structure from the suspension loop 102 which maintains the arm of the patient suspended from the suspension cord 102 while retaining the arm of the patient in a relaxed passive state. The arm harness 138 comprises a suspension handle 140, an extension member 142, and an arm wrap assembly 144. The suspension handle 140 and extension member 142 are formed from a rigid, high-strength material, such as a metal or plastic. The suspension handle 140 and extension member 142 can either be separate, but interconnected components, or can alternately be fabricated as an integrated unitary structure. In either case, the extension member 142 extends from the suspension handle 140 in an arcuate path upwardly over the suspension handle 140 in substantially coplanar alignment with the suspension handle 140. The end 146 of the extension member 142, which extends away from the suspension handle 140, is a free end disengaged from the remainder of the arm harness 138 and is sized and configured to be received and releasably retained in the loop 114. Although not shown, a hook may alternatively be mounted on the end 146 which is sized and configured to be received and releasably retained in the loop 114.

The arm wrap assembly 144 includes a wrist wrap 148, a hand wrap 150, and a connective portion 152, which are fabricated from a flexible, stretchable, elastic material such as a fabric or an elastomer. The arm wrap assembly 144 is a segment of the above-recited material sewn into a tubular configuration, which is sized to receive the suspension handle 140. Thus, the arm wrap assembly 144 is connected to the suspension handle 140 by fitting the suspension handle 140 through the connective portion 152. The wrist wrap 148 and hand wrap 150 are attached to the connective portion 152, preferably by sewing along a seam 154, with the longitudinal axis of the wrist wrap 148 aligned in a direction substantially parallel to the longitudinal axis of the suspension handle 140 and with the longitudinal axis of the hand wrap 150 aligned in a direction substantially perpendicular to the longitudinal axis of the suspension handle 140.

The patient 132 couples the arm harness 138 with the arm associated with the involved shoulder 134 by initially making a fist around the suspension handle 140. The wrist wrap 148 is then wrapped around the wrist and fastened back onto itself by conventional fastening means 156, such as hook and loop fasteners, (commercially known as VELCRO) which are provided at the desired fastening points. Finally, the hand wrap 150 is wrapped over the top of the fist between the suspension handle 140 and the extension member 142 and fastened onto the back of the wrist wrap 148 likewise by conventional fastening means 158 which are provided at the desired fastening points. Once the arm harness 138 is affixed to the arm, the arm harness 138 retains the arm, which enables the patient 132 to relax the fist around the suspension handle 140 and maintain the arm in a passive state.

The patient 132 places the end 146 of the extension member 142 in the loop 114 to suspend the arm associated with the involved shoulder 134 from the arm engagement point 110 of the suspension cord 102. Since the suspension cord 102 is at a position of full extension or some other fixed maximum length of the extension segment 118, the involved shoulder 134 is at a position substantially less than 90° of elevation when the arm is suspended from the arm engagement point 110. Accordingly, the patient 132 enters a new manual input by continuously depressing the up key 124 on the user interface 64 to communicate an instruction to the controller via the communications cord 80. The controller responds to the instruction by transmitting electrical power to the motor 97 via the electrical line 101, which activates the motor 97 and causes the motor 97 and correspondingly the spool 98 to rotate in a counterclockwise direction, thereby reeling the suspension cord 102 back onto the spool 98 and decreasing the length of the extension segment 118. When the suspension cord 102 raises the arm harness 138 and correspondingly the upper arm associated with the involved shoulder 134 to a level where the involved shoulder 134 is at a predetermined known angular elevation, the patient 132 releases the up key 124, which communicates another instruction to the controller to deactivate the motor 97. When the motor 97 is deactivated, the patient 132 enters a manual input by momentarily depressing the calibration key 120 to complete the calibration procedure. A preferred known angular elevation of the involved shoulder for purposes of the calibration step is 90° of elevation because it occurs when the upper arm is parallel to the support surface 28, which can be readily determined by the patient.

Depression of the calibration key 120 causes the controller to store the calibration data, i.e., the position of the motor 97 and correspondingly the length of the extension segment 118 which positions the involved shoulder 134 of the particular seated patient 132 at the known angular elevation, and establishes the known angular elevation, e.g., 90° of elevation, as a reference angular elevation. When the treatment performance stage is subsequently executed, the controller monitors the degree of rotation of the motor and the instantaneous operational position of the motor. The controller is preprogrammed to use the data relating to the instantaneous operational position of the motor, the stored calibration data and other stored data relating to the fixed geometry of the winch 96 to calculate and communicate an accurate measure of the instantaneous angular position of the involved shoulder 134 (expressed in degrees of elevation) to the output display 78 via the communications cord 80 for the benefit of the patient 132 or other user.

Upon completion of the calibration step, the patient 132 enters a manual input by continuously depressing the down key 126 to perform the lower treatment limit set step. Continuously depressing the down key 126 continuously increases the length of the extension segment 118. The patient 132 ultimately releases the down key 126 when the suspension cord 102 drops the arm harness 138 and correspondingly the arm retained thereby to a level which corresponds to a predetermined minimum desired angular elevation of the involved shoulder 134 displayed on the output display 78 or alternatively which corresponds to an angular elevation of the involved shoulder 134 where the patient 132 experiences tightness or pain in the involved shoulder 134. The minimum angular elevation is preferably less than the reference angular elevation. Release of the down key 126 instructs the controller to deactivate the motor 97 and causes the controller to store the lower treatment limit of shoulder elevation, i.e., the position of the motor 97 and correspondingly the length of the extension segment 118, which positions the involved shoulder 134 of the seated patient 132 at the minimum desired angular elevation.

Upon completion of the lower treatment limit set step, the patient 132 enters a manual input by continuously depressing the up key 124 to continuously shorten the length of the extension segment 118. The patient 132 ultimately releases the up key 124 when the suspension cord 102 raises the arm harness 138 and correspondingly the arm retained thereby to a level which corresponds to a predetermined maximum desired angular elevation of the involved shoulder 134 displayed on the output display 78 or alternatively which corresponds to an angular elevation of the involved shoulder 134 where the patient 132 experiences tightness or pain in the involved shoulder 134. The maximum angular elevation is preferably greater than the reference angular elevation. Release of the up key 124 instructs the controller to deactivate the motor 97 and causes the controller to store the upper treatment limit of shoulder elevation, i.e., the position of the motor 97 and correspondingly the length of the extension segment 118, which positions the involved shoulder 134 of the seated patient 132 at the maximum desired angular elevation.

Upon completion of the treatment definition stage, the treatment performance stage may be initiated at any time, whereby the CPM device 10 automatically effects continuous passive motion flexion treatment of the involved shoulder 134 of the patient 132. The treatment performance stage satisfies the commonly accepted criteria of "continuous passive motion" insofar as the CPM device 10 actively moves the involved shoulder 134 through a controlled range of motion specified in the treatment definition stage for a prolonged interrupted time period without the arm or associated involved shoulder 134 bearing weight and without placing a substantial force load on the arm or associated involved shoulder 134. The arm of the associated involved shoulder 134 hangs suspended from the arm harness 138 as dead weight for the duration of the treatment performance stage. As such, the arm and associated involved shoulder 134 are fully passive throughout the treatment performance stage, i.e., perform no active function and are fully relaxed.

The patient 132 commences the treatment performance stage by momentarily depressing the start/stop key 128 to communicate an instruction to the controller to activate the motor 97. Once activated, the motor 97 automatically and continuously cycles the suspension cord 102, and correspondingly the arm harness 138 and arm of the involved shoulder 134, up and down between the lower and upper treatment limits, respectively, under the control of the controller. Specifically, the controller automatically causes the motor 97 to reverse direction every time the motor 97 reaches the upper or lower treatment limit stored in the memory of the controller and causes the motor 97 to continue in the new direction until the next treatment limit is reached, whereupon the motor 97 reverses direction anew. A single round trip from the lower treatment limit to the upper treatment limit and back to the lower treatment limit or vice versa constitutes one complete treatment cycle of the treatment performance stage. The treatment cycles are repeated continuously for as long as desired. For example, the treatment cycles may be performed repetitively for a predetermined fixed prolonged time period prescribed by a health care practitioner, such as 15 minutes, 30 minutes, one hour, or even more, depending on the needs of the patient 132.

The CPM device 10 proceeds automatically under the control of the controller for the duration of the treatment performance stage. Thus, a user is not required to enter any manual inputs for continuous operation once the treatment performance stage is initiated. Nevertheless, a limited number of optional manual inputs are available to a user during the treatment performance stage, if desired. In particular, momentarily depressing the speed key 122 at any time during the treatment performance stage optionally enables a user to enter an adjustment to the speed of the motor 97. The motor 97 preferably has three speed levels, low, medium and high. Momentarily depressing the speed key 122 instructs the controller to toggle the motor 97 to the next successive speed level. If a user desires to terminate or interrupt the treatment performance stage, the user momentarily depresses the start/stop key 128, which deactivates the motor 97. If a user desires to resume the treatment performance stage, the user simply momentarily depresses the start/stop key 128 again. The calibration and upper and lower treatment limit settings set during the treatment definition stage are not lost when the treatment performance stage is terminated or interrupted. The last settings remain stored in the memory of the controller until replaced by new settings entered during execution of a subsequent treatment definition stage.

The controller of the CPM device 10 is additionally preprogrammed with certain automatic safety features. In particular, whenever the counter force on the motor 97 is withdrawn while the motor 97 is activated, e.g., when the arm harness 138 becomes disconnected from the suspension cord 102, the controller automatically deactivates the motor 97. If the motor 97 remains deactivated without a counter force on it and the suspension cord 102 is at least partly extended from the winch housing 14 for a predetermined fixed time period, e.g., 60 seconds, the controller automatically returns the suspension cord 102 to the position of full contraction.

From the above, it is apparent to the skilled artisan that alternate embodiments of operating methods employing the CPM device 10 are possible within the scope of the present invention simply by modifying the orientation of the patient relative to the CPM device 10. For example, referring to FIG. 9, an alternate embodiment of an operating method is shown which employs the CPM device 10 for continuous passive motion abduction treatment of the involved shoulder 134. In accordance with the present embodiment, although the involved shoulder 134 of the patient 132 remains in approximate vertical alignment with the winch housing 14 and suspension cord 102, the seated patient 132 is rotated 90° from the position of the patient 132 shown in FIG. 7. As such, the seated patient 132 of the present embodiment has a sideways orientation relative to the CPM device 10 which effects shoulder abduction rather than a straight-on orientation which effects shoulder flexion. Although not shown, further alternate embodiments are possible by rotating the seated patient 132 to any position between 0° and 90° from the position of the patient 132 shown in FIG. 7 to effect alternate shoulder treatments other than simply flexion or abduction.

In still other alternate embodiments of the present invention, the CPM device 10 can be employed in a manner readily within the purview of the skilled artisan to desirably effect elbow or shoulder motion of a reclining or standing patient rather than a seated patient. For example, the patient can be reclining in a bed on a support surface positioned beneath the CPM device 10. Such embodiments are particularly advantageous where the patient is not ambulatory or otherwise unable to sit or stand. The CPM device 10 can also be employed in a manner readily within the purview of the skilled artisan to desirably effect treatment an elbow joint of the seated, reclining or standing patient.

While the forgoing preferred embodiments of the invention have been described and shown, it is understood that alternatives and modifications, such as those suggested and others, may be made thereto and fall within the scope of the invention.

We claim:

1. A passive motion device for rehabilitative treatment of an elbow or shoulder comprising:

a frame transitionable between an operating configuration and a relatively more compact transport or storage configuration, said frame having an upper end and a lower end and further including, a cross member having a first end and a second end, a first upright segmented into a first lower upright and a first upper upright and having a first end and a second end, said first end of said first upright connected proximal to said first end of said cross member, a second upright longitudinally aligned with said first upright, segmented into a second lower upright and a second upper upright, and having a first end and a second end, said first end of said second upright connected proximal to said second end of said cross member, a first upright hinge rotationally coupling said first lower and upper uprights and a second upright hinge rotationally coupling said second lower and upper uprights;

a first stabilizer having a first end and a second end, said first end of said first stabilizer connected proximal to said first end of said cross member and said first upright and said first stabilizer selectively rotatable relative to one another about said cross member, and a second stabilizer having a first end and a second end, said first end of said second stabilizer connected proximal to said second end of said cross member and said second upright and said second stabilizer selectively rotatable relative to one another about said cross member, wherein said first and second stabilizers and said cross member have an essentially horizontal orientation, said first and second uprights have an essentially vertical orientation with said second end of said first stabilizer distal to said first upright and said second end of said second stabilizer distal to said second upright, and said first and second stabilizers and said cross member are configured to engage a horizontal support surface and provide free standing support for said first and second uprights when said frame is in said operating configuration, and further wherein said frame is transitionable from said operating configuration to said transport or storage configuration by selective rotation of said first upright and said first stabilizer relative to one another about said cross member and selective rotation of said second upright and said second stabilizer relative to one another about said cross member such that said first and second stabilizers, said cross member, and said first and second uprights have an essentially coplanar orientation with said second end of said first stabilizer proximal to said first upright and said second end of said second stabilizer proximal to said second upright when said frame is in said transport or storage configuration;

a spool rotationally displacable in a first direction or a second direction;

a motor linked with said spool to effect motorized rotational displacement of said spool;

a cord suspended from a point proximal to said second ends of said first and second uprights by a variable extension length increasing when said spool is rotationally displaced in said first direction and decreasing when said spool is rotationally displaced in said second direction;

an arm harness associated with said cord; and a controller in communication with said motor maintaining said motorized rotational displacement of said spool within upper and lower rotational displacement limits corresponding to upper and lower operational limits of said motor.

2. The passive motion device of claim 1 wherein said frame is transitionable from said operating configuration to said transport or storage configuration by rotating said first lower and upper uprights toward one another about said first upright hinge and rotating said second lower and upper uprights toward one another about said second upright hinge.

3. A passive motion device for rehabilitative treatment of an elbow or shoulder comprising:

a frame transitionable between an operating configuration and a relatively more compact transport or storage configuration, said frame having an upper end and a lower end and further including, a cross member having a first end and a second end, a first upright segmented into a first lower upright and a first upper upright and having a first end and a second end, said first end of said first upright connected proximal to said first end of said cross member, a second upright longitudinally aligned with said first upright, segmented into a second lower upright and a second upper upright, and having a first end and a second end, said first end of said second upright connected proximal to said second end of said cross member, a first upright hinge rotationally coupling said first lower and upper uprights and a second upright hinge rotationally coupling said second lower and upper uprights;

a first stabilizer having a first end and a second end, said first end of said first stabilizer connected proximal to said first end of said cross member and said first upright and said first stabilizer selectively rotatable relative to one another about said cross member, and a second stabilizer having a first end and a second end, said first end of said second stabilizer connected proximal to said second end of said cross member and said second upright and said second stabilizer selectively rotatable relative to one another about said cross member, wherein said first and second stabilizers and said cross member have an essentially horizontal orientation, said first and second uprights have an essentially vertical orientation with said second end of said first stabilizer distal to said first upright and said second end of said second stabilizer distal to said second upright, and said first and second stabilizers and said cross member are configured to engage a horizontal support surface and provide free standing support for said first and second uprights when said frame is in said operating configuration, and further wherein said frame is transitionable from said operating configuration to said transport or storage configuration by selective rotation of said first upright and said first stabilizer relative to one another about said cross member and selective rotation of said second upright and said second stabilizer relative to one another about said cross member such that said first and second stabilizers, said cross member, and said first and second uprights have an essentially coplanar orientation with said second end of said first stabilizer proximal to said first upright and said second end of said second stabilizer proximal to said second upright when said frame is in said transport or storage configuration;

a spool rotationally displacable in a first direction or a second direction;

a motor linked with said spool to effect motorized rotational displacement of said spool;

a cord suspended from a point proximal to said second ends of said first and second uprights by a variable extension length increasing when said spool is rotationally displaced in said first direction and decreasing when said spool is rotationally displaced in said second direction;

an arm harness associated with said cord;

a controller in communication with said motor maintaining said motorized rotational displacement of said spool within upper and lower rotational displacement limits corresponding to upper and lower operational limits of said motor; and a user interface in communication with said controller, wherein said user interface includes means for a user to enter said upper and lower operational limits of said motor into said controller for retention by said controller.

4. A passive motion device for rehabilitative treatment of an elbow or shoulder comprising:

a frame transitionable between an operating configuration and a relatively more compact transport or storage configuration, said frame having an upper end and a lower end and further including, a cross member having a first end and a second end, a first upright segmented into a first lower upright and a first upper upright and having a first end and a second end, said first end of said first upright connected proximal to said first end of said cross member, a second upright longitudinally aligned with said first upright, segmented into a second lower upright and a second upper upright, and having a first end and a second end, said first end of said second upright connected proximal to said second end of said cross member, a first upright hinge rotationally coupling said first lower and upper uprights and a second upright hinge rotationally coupling said second lower and upper uprights;

a first stabilizer having a first end and a second end, said first end of said first stabilizer connected proximal to said first end of said cross member and said first upright and said first stabilizer selectively rotatable relative to one another about said cross member, and a second stabilizer having a first end and a second end, said first end of said second stabilizer connected proximal to said second end of said cross member and said second upright and said second stabilizer selectively rotatable relative to one another about said cross member, wherein said first and second stabilizers and said cross member have an essentially horizontal orientation, said first and second uprights have an essentially vertical orientation with said second end of said first stabilizer distal to said first upright and said second end of said second stabilizer distal to said second upright, and said first and second stabilizers and said cross member are configured to engage a horizontal support surface and provide free standing support for said first and second uprights when said frame is in said operating configuration, and further wherein said frame is transitionable from said operating configuration to said transport or storage configuration by selective rotation of said first upright and said first stabilizer relative to one another about said cross member and selective rotation of said second upright and said second stabilizer relative to one another about said cross member such that said first and second stabilizers, said cross member, and said first and second uprights have an essentially coplanar orientation with said second end of said first stabilizer proximal to said first upright and said second end of said second stabilizer proximal to said second upright when said frame is in said transport or storage configuration;

a spool rotationally displacable in a first direction or a second direction;

a motor linked with said spool to effect motorized rotational displacement of said spool;

a cord suspended from a point proximal to said second ends of said first and second uprights by a variable extension length increasing when said spool is rotationally displaced in said first direction and decreasing when said spool is rotationally displaced in said second direction;

an arm harness associated with said cord;

a controller in communication with said motor maintaining said motorized rotational displacement of said spool within upper and lower rotational displacement limits corresponding to upper and lower operational limits of said motor; and a user interface in communication with said controller, wherein said user interface includes means for displaying instantaneous operational positions of said motor to said user.

5. A passive motion device for rehabilitative treatment of an elbow or shoulder comprising:

a frame transitionable between an operating configuration and a relatively more compact transport or storage configuration, said frame having an upper end and a lower end and further including, a cross member having a first end and a second end, a first upright segmented into a first lower upright and a first upper upright and having a first end and a second end, said first end of said first upright connected proximal to said first end of said cross member, a second upright longitudinally aligned with said first upright, segmented into a second lower upright and a second upper upright, and having a first end and a second end, said first end of said second upright connected proximal to said second end of said cross member, a first upright hinge rotationally coupling said first lower and upper uprights and a second upright hinge rotationally coupling said second lower and upper uprights;

a first stabilizer having a first end and a second end, said first end of said first stabilizer connected proximal to said first end of said cross member and said first upright and said first stabilizer selectively rotatable relative to one another about said cross member, and a second stabilizer having a first end and a second end, said first end of said second stabilizer connected proximal to said second end of said cross member and said second upright and said second stabilizer selectively rotatable relative to one another about said cross member, wherein said first and second stabilizers and said cross member have an essentially horizontal orientation, said first and second uprights have an essentially vertical orientation with said second end of said first stabilizer distal to said first upright and said second end of said second stabilizer distal to said second upright, and said first and second stabilizers and said cross member are configured to engage a horizontal support surface and provide free standing support for said first and second uprights when said frame is in said operating configuration, and further wherein said frame is transitionable from said operating configuration to said transport or storage configuration by selective rotation of said first upright and said first stabilizer relative to one another about said cross member and selective rotation of said second upright and said second stabilizer relative to one another about said cross member such that said first and second stabilizers, said cross member, and said first and second uprights have an essentially coplanar orientation with said second end of said first stabilizer proximal to said first upright and said second end of said second stabilizer proximal to said second upright when said frame is in said transport or storage configuration;

a spool rotationally displacable in a first direction or a second direction;

a motor linked with said spool to effect motorized rotational displacement of said spool;

a cord suspended from a point proximal to said second ends of said first and second uprights by a variable extension length increasing when said spool is rotationally displaced in said first direction and decreasing when said spool is rotationally displaced in said second direction;

an arm harness associated with said cord;

a controller in communication with said motor maintaining said motorized rotational displacement of said spool within upper and lower rotational displacement limits corresponding to upper and lower operational limits of said motor; and a user interface in communication with said controller, wherein said user interface includes means for displaying instantaneous operational positions of said motor to said user and wherein said instantaneous operational positions of said motor are between said upper and lower operational limits of said motor and are expressed as position data of said elbow or shoulder.

6. A passive motion device for rehabilitative treatment of an elbow or shoulder comprising:

a frame transitionable between an operating configuration and a relatively more compact transport or storage configuration, said frame having an upper end and a lower end and further including, one or more rotational wheels for support and transport of said device when said frame is in said transport or storage configuration, a cross member having a first end and a second end, a first upright segmented into a first lower upright and a first upper upright and having a first end and a second end, said first end of said first upright connected proximal to said first end of said cross member, a second upright longitudinally aligned with said first upright, segmented into a second lower upright and a second upper upright, and having a first end and a second end, said first end of said second upright connected proximal to said second end of said cross member, a first upright hinge rotationally coupling said first lower and upper uprights and a second upright hinge rotationally coupling said second lower and upper uprights;

a first stabilizer having a first end and a second end, said first end of said first stabilizer connected proximal to said first end of said cross member and said first upright and said first stabilizer selectively rotatable relative to one another about said cross member, and a second stabilizer having a first end and a second end, said first end of said second stabilizer connected proximal to said second end of said cross member and said second upright and said second stabilizer selectively rotatable relative to one another about said cross member, wherein said first and second stabilizers and said cross member have an essentially horizontal orientation, said first and second uprights have an essentially vertical orientation with said second end of said first stabilizer distal to said first upright and said second end of said second stabilizer distal to said second upright, and said first and second stabilizers and said cross member are configured to engage a horizontal support surface and provide free standing support for said first and second uprights when said frame is in said operating configuration, and further wherein said frame is transitionable from said operating configuration to said transport or storage configuration by selective rotation of said first upright and said first stabilizer relative to one another about said cross member and selective rotation of said second upright and said second stabilizer relative to one another about said cross member such that said first and second stabilizers, said cross member, and said first and second uprights have an essentially coplanar orientation with said second end of said first stabilizer proximal to said first upright and said second end of said second stabilizer proximal to said second upright when said frame is in said transport or storage configuration;

a spool rotationally displacable in a first direction or a second direction;

a motor linked with said spool to effect motorized rotational displacement of said spool;

a cord suspended from a point proximal to said second ends of said first and second uprights by a variable extension length increasing when said spool is rotationally displaced in said first direction and decreasing when said spool is rotationally displaced in said second direction;

an arm harness associated with said cord; and a controller in communication with said motor maintaining said motorized rotational displacement of said spool within upper and lower rotational displacement limits corresponding to upper and lower operational limits of said motor.

7. A passive motion device for rehabilitative treatment of an elbow or shoulder comprising:

a frame transitionable between an operating configuration and a relatively more compact transport or storage configuration, said frame having an upper end and a lower end and further including, a cross member having a first end and a second end, a first upright segmented into a first lower upright and a first upper upright and having a first end and a second end, said first end of said first upright connected proximal to said first end of said cross member, a second upright longitudinally aligned with said first upright, segmented into a second lower upright and a second upper upright, and having a first end and a second end, said first end of said second upright connected proximal to said second end of said cross member, a first upright hinge rotationally coupling said first lower and upper uprights and a second upright hinge rotationally coupling said second lower and upper uprights;

a first stabilizer having a first end and a second end, said first end of said first stabilizer connected proximal to said first end of said cross member and said first upright and said first stabilizer selectively rotatable relative to one another about said cross member, and a second stabilizer having a first end and a second end, said first end of said second stabilizer connected proximal to said second end of said cross member and said second upright and said second stabilizer selectively rotatable relative to one another about said cross member, wherein said first and second stabilizers and said cross member have an essentially horizontal orientation, said first and second uprights have an essentially vertical orientation with said second end of said first stabilizer distal to said first upright and said second end of said second stabilizer distal to said second upright, and said first and second stabilizers and said cross member are configured to engage a horizontal support surface and provide free standing support for said first and second uprights when said frame is in said operating configuration, and further wherein said frame is transitionable from said operating configuration to said transport or storage configuration by selective rotation of said first upright and said first stabilizer relative to one another about said cross member and selective rotation of said second upright and said second stabilizer relative to one another about said cross member such that said first and second stabilizers, said cross member, and said first and second uprights have an essentially coplanar orientation with said second end of said first stabilizer proximal to said first upright and said second end of said second stabilizer proximal to said second upright when said frame is in said transport or storage configuration;

a spool rotationally displacable in a first direction or a second direction;

a motor linked with said spool to effect motorized rotational displacement of said spool;

a cord suspended from a point proximal to said second ends of said first and second uprights by a variable extension length increasing when said spool is rotationally displaced in said first direction and decreasing when said spool is rotationally displaced in said second direction;

an arm harness associated with said cord;

a controller in communication with said motor maintaining said motorized rotational displacement of said spool within upper and lower rotational displacement limits corresponding to upper and lower operational limits of said motor; and a user interface in communication with said controller, wherein said user interface includes means for displaying instantaneous operational positions of said motor to said user, wherein said instantaneous operational positions of said motor are between said upper and lower operational limits of said motor and are expressed as position data of said elbow or shoulder, and wherein said upper and lower operational limits of said motor are entered into said controller in response to said position data of said elbow or shoulder displayed by said user interface.

8. The passive motion device of claim 1 wherein said frame is transitionable between said operating configuration and said transport or storage configuration by folding.

9. The passive motion device of claim 1 wherein said frame is transitionable from said operating configuration to said transport or storage configuration by rotating said first lower and upper uprights toward one another about said first upright hinge.

10. The passive motion device of claim 1 wherein said frame is transitionable from said operating configuration to said transport or storage configuration by rotating said second lower and upper uprights toward one another about said second upright hinge.

11. The passive motion device of claim 6 wherein said one or more rotational wheels includes a wheel attached to said first end of said first upright of said frame.

12. The passive motion device of claim 6 wherein said one or more rotational wheels includes a wheel attached to said first end of said second upright of said frame.

13. The passive motion device of claim 6 wherein said one or more rotational wheels includes a first wheel attached to said first end of said first upright of said frame and a second wheel attached to said first end of said second upright of said frame.

14. The passive motion device of claim 6 wherein said one or more rotational wheels are essentially inoperable when said frame is in said operating configuration.

* * * * *